United States Patent [19]

Hood

[11] 4,207,176

[45] Jun. 10, 1980

[54] RECLAMATION OF UNSET CONCRETE AGGREGATES

[75] Inventor: Maxwell G. Hood, Cattai, Australia

[73] Assignee: Fowler Rex Pty. Ltd., Brookyate, Australia

[21] Appl. No.: 889,068

[22] Filed: Mar. 22, 1978

[30] Foreign Application Priority Data

Mar. 30, 1977 [AU] Australia ..... PC9602

[51] Int. Cl.[2] ..... B03B 11/00; B03B 7/00

[52] U.S. Cl. ..... 209/44; 209/482; 209/494

[58] Field of Search ..... 209/13, 17, 18, 155–157, 209/159, 270, 268, 293, 294, 297, 241, 255, 451, 452, 44, 494

[56] References Cited

U.S. PATENT DOCUMENTS

| | | | |
|---|---|---|---|
| 256,183 | 4/1882 | Wilhelm | 209/452 |
| 402,845 | 5/1889 | Loughran | 209/270 |
| 1,784,246 | 12/1930 | Newton | 209/270 |
| 1,958,309 | 5/1934 | Lockett | 209/452 |
| 2,119,414 | 5/1938 | Blanchard | 209/452 |
| 2,836,299 | 5/1958 | Johnson | 209/270 |
| 2,983,378 | 5/1961 | Hilkemeier | 209/452 |
| 3,815,737 | 6/1974 | Katter | 209/452 |

*Primary Examiner*—Robert Halper
*Assistant Examiner*—Jon Hokanson
*Attorney, Agent, or Firm*—Fred Philpitt

[57] ABSTRACT

Apparatus for reclaiming aggregate from unset concrete comprising an inclined rotating drum, a reservoir space in the drum, and means for separating the slurry in the reservoir from aggregate in the reservoir, the slurry exiting from the lower end of the drum and the aggregate exiting from the upper part of the drum.

7 Claims, 3 Drawing Figures

12
9
12
3
4
17
8
5a
4
22
13
1
14
2
7
21
6
5
15
1

RECLAMATION OF UNSET CONCRETE AGGREGATES

This invention relates to the reclamation and disposal of unset concrete. As is well known it is conventional these days for concrete to be produced at specialised production sites and transported to the work site by way of trucks incorporating a rotating drum in which the concrete is kept in a mixed condition during transport. It frequently happens that surplus concrete is supplied at the work site and this is then returned to the production site and has to be disposed of. Not only is its disposal a problem but also it is desirable that at least the aggregate materials be recovered in a clean state for re-use.

Hitherto, various techniques have been utilized to reclaim the aggregate materials from the surplus concrete. For example, a machine comprising a large rectangular steel pit filled with water and fitted with chain-supported scrapers which slowly travel along the floor of the pit and up an inclined end portion of the floor at the discharge end of the pit, to clean and remove the aggregate and leaving behind the slurry has been used. Eventually the slurry concentration becomes such that the operation has to cease and the slurry removed from the pit and taken to a dumping station where it is allowed to set as filling or the like.

In another example of the prior art, there is provided an inclined rotary drum with a central opening at its lower end and into which concrete is put to be churned and diluted. The slurry overflows through said opening and the sand and metal or other aggregate is eventually discharged from the top end of the drum by means of Archemedian screw-type conveyor flutes on the inner surface of the drum's curved wall.

In the latter of the above-mentioned prior art expedients it was necessary to carefully and gradually feed in the surplus concrete to avoid overflow of aggregate with the slurry and to prevent spillage of slurry and concrete. This is a serious disability because the transporter truck drivers at the end of a day's work tend to discharge their truck's concrete as quickly as possible to avoid extending their working day.

Thus an object of the invention is to provide an efficient and durable apparatus for the reclamation of the aggregate and the disposal of the slurry which is able to accommodate higher in-feed rates, if not batch feeding, without detriment to the operation of the apparatus.

A secondary object met by preferred embodiments of the invention is to provide means which not only reclaim the sand and aggregate but also separate them one from the other so that they may be reclaimed separately which has not always been the case with prior art machines.

The invention consists of an apparatus for the reclamation of aggregate from un-set concrete comprising an inclined main drum open at its top end and mounted for rotation about its axis, means to rotate said drum about said axis, means to charge said drum through its top opening, slurry outlet means whereof the intake is substantially coincident with the axis of rotation of said drum and spaced from the bottom end of said drum whereby a substantial working space is provided within said drum for the accumulation of material to be treated before slurry commences to flow into said intake and out of said drum through said outlet means and conveyor means whereby aggregate is shifted from said working space to aggregate discharge openings at or near the top end of said drum.

The preferred embodiment of the invention is described below with reference to the accompanying drawings.

Figure 1:
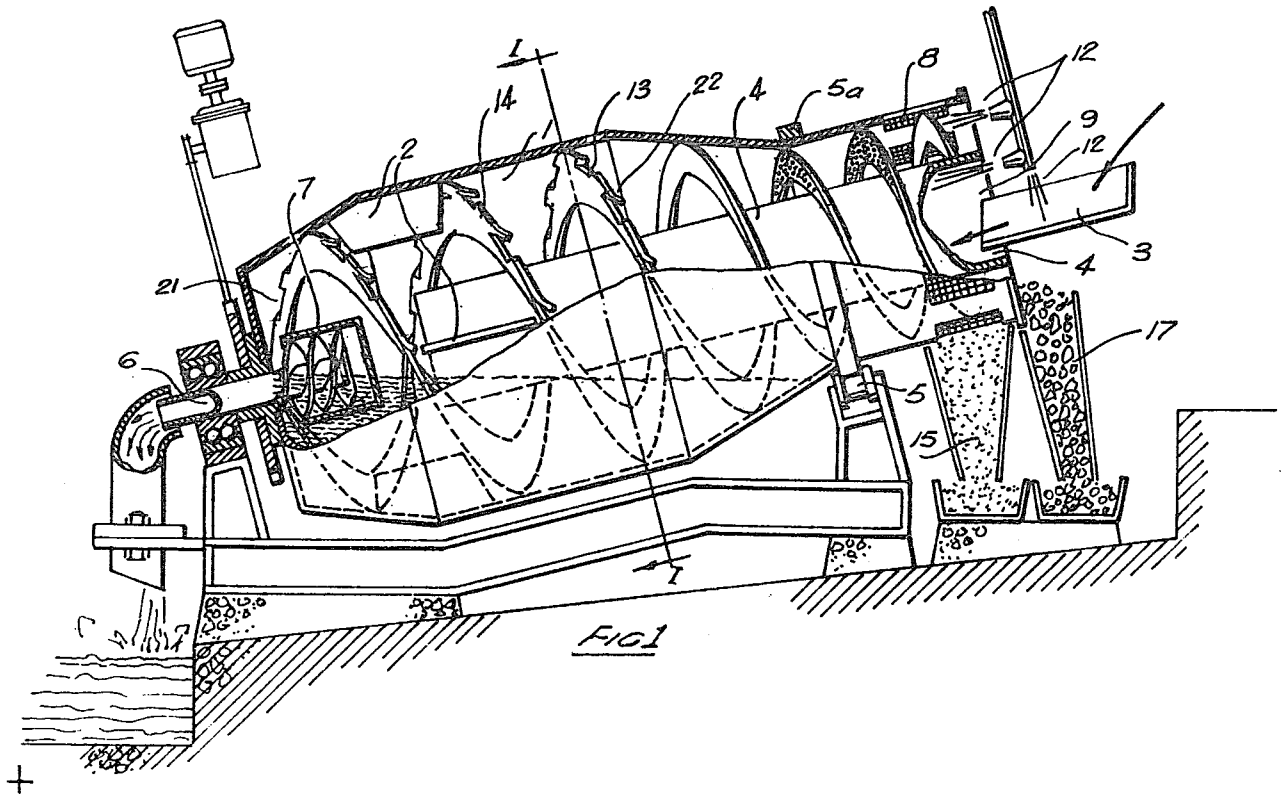
FIG. 1 is a partly sectioned side elevation of a reclamation apparatus according to the invention.

The illustrated apparatus comprises an inclined main drum 1 open at its upper end and mounted for rotation about its axis. Preferably the drum has the general shape outlined in FIG. 1 but it may be more or less pear shaped. A transit concrete mixer drum may be adapted for the purpose if desired. The drum 1 is supported for rotation by an axle 6 extending fixedly from the lower closed end of the drum through a pedestal bearing on a frame bed supporting the drum and at or near its upper end by a pair of rollers 5 engaging a circumferential rail 5*a* on and encircling drum 1.

Waste concrete to be treated is charged to drum 1 by means of charging chute 3 part of which projects into cylindrical chute 4 which in turn protrudes into the opening 9 of drum 1. Cylindrical chute 4 is of smaller diameter than drum 1 and preferably co-axial with drum 1.

Sprays 12 are directed onto the charging chute 3 thereby assisting waste concrete thereon into cylindrical chute 4. The wet waste concrete is washed and/or gravitates towards the lower end of drum 1, which comprises a barrier wall.

Fins 2 fixed to the inner surface of drum 1 at its closed lower end apply a tumbling action whereby wet concrete in drum 1 is lifted and then allowed to fall, thus assisting to continually break up the wet concrete and to keep it in a state of agitation in the working space.

Archemedian screw type conveyor flutes 14 fixed to the inner surface of the curved wall of drum 1 continually urge aggregate and sand towards the upper drum opening 9 where the solids are discharged through the clearance space defined by the outer surface of cylindrical chute 4 and the inner surface of drum 1. Preferably the screw conveyor flutes 14 commence at the lower end of drum 1 at a point nearer to the bottom of the drum than the intake of the slurry outlet means 7 described below.

Preferably also a sandscreen 8 is provided in a circumferential zone of drum 1 towards drum opening 9 so that clean sand urged towards the drum opening 9 by screw conveyor flutes 14 is separated from aggregate, the clean sand passing through screen 8 and being channelled via a hopper 15 onto one conveyor for delivery to bins while clean aggregate passes said zone and is discharged at drum opening 9 into a second hopper 17 and thereby onto a second conveyor 18.

Sprays 12 are also directed either side of chute 3 into the space between drum 1 and cylindrical chute 4 so that clean water flows against sand and aggregate as they are conveyed towards discharge between the cylindrical chute 4 and drum opening 9 thus removing any final trace of cement slurry from those solids.

The screw flights of the Archemedian screw type conveyor reduce in pitch so that the speed of movement of aggregate lessens towards drum opening 9 thus ensuring that said aggregate is thoroughly cleaned. The screw flutes 14 may be provided with suitably spaced holes or slots 13 arranged circumferentially around flutes 14 and adjacent to the seam whereby the flutes 14 join with the inner surface of drum 1. These openings serve to allow slurry and wash water to run back through each spiral to the tumbling area and substantially to prevent slurry or clean water from reaching screen zone 8 or drum opening 9.

Preferably the openings consist of slots 21 cut in the flute 14 around its outer circumference, the circumferential length of the slot edges corresponding in total to approximately half the circumferential length of the flute. The slots are provided at their leading edge with a deflection surface 22 which may be made by cutting the flute a short distance on lines projecting from both sides of the slot and bending the flute between such cuts 23 to angle out of the plane of the flute. Solids are thereby deflected over the slots while slurry flows through the slots back to the tumbling area.

In the upper regions of main drum 1 it has been found to be more efficient to fit slots in the plane of the flutes with wire mesh screen cloth rather than leading edge deflectors or to compose the flutes of a mesh.

Figure 2:
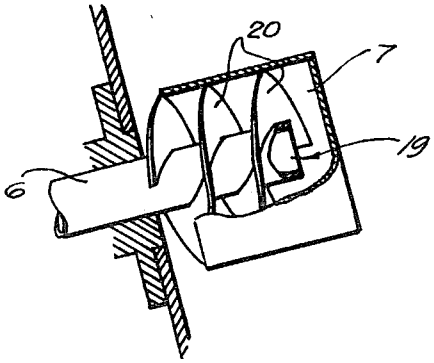
FIG. 2 is a sectional view of a slurry outlet means, being a component of the apparatus of FIG. 1, drawn to a larger scale.
Figure 3:
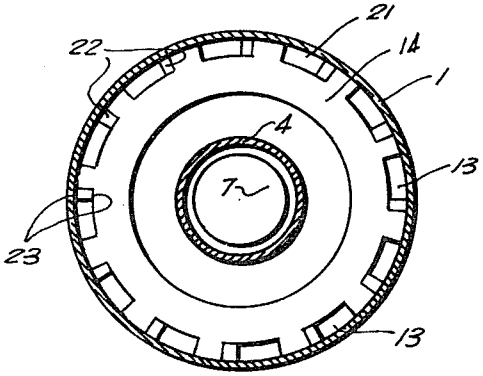
FIG. 3 is a sectional view taken on line 1—1.

For preference the slurry outlet means 7 employ a hollow tube as axle 6 extending into drum 1 for a distance which permits material undergoing treatment to accumulate within drum 1 before slurry commences to flow out through tubular axle 6. For preference also the extension of hollow axle 6 into drum 1 is partly surrounded by a canister 7 co-axial with drum 1 and open at its lower end. Said canister is preferably fixed to the hollow axle 6 but may be fixed to the drum wall. As shown in FIG. 2, hollow axle 6 has an aperture or apertures 19 close to the upper end of the canister. In the preferred embodiment apertures 19 are slots. Canister 7 is fitted with an internal Archemedian screw 20 of opposite hand to screw flutes 14 of the main drum. The purpose of canister 7 and screw 20 is to allow slurry to discharge from drum 1 through the aperture 19 in hollow axle 6 without being contaminated by sand and aggregate which might otherwise discharge with the slurry in the event of drum 1 being overfilled with waste concrete. Any solid material entering the canister 7 from below is conveyed towards and out the bottom end of the canister 7 by said screw 20. The slurry flowing downwardly through hollow axle 6 may discharge into an appropriate chute or trough leading to a storage pit or the like.

An alternative slurry outlet means comprises at least one tube extending radially to outlets through the wall of drum 1 from a canister fixed to rotate co-axially with the drum, said canister open at its bottom end. The radial tube extends into the canister at or near its top end and thus a liquid level is established by virtue of the discharge of slurry through the radial tube whenever its opening into the canister falls below the top of the mouth of the canister. For preference there is more than one radial tube and for perference they are equally angularly spaced. For example, there may be three or, more preferably, six such tubes. The slurry flowing downwardly through hollow axle 6 or through tubes extending radially from a canister through the drum wall or both may be treated or disposed of in any conventional way. A common process for example, is to allow it to settle in a pit provided with baffles so that the overflow flowing from the bottom end of the pit is virtually clean water. The pit gradually fills up with thickening slurry until such time as the cleanliness of the overflow becomes unacceptable, at which stage the operation ceases until the pit is cleaned and the concentrated slurry removed from it for dumping.

The apparatus may be provided with a timer switch which allows it to carry out reclamation on a batch basis and to stop automatically when a pre-set time has elapsed.

I claim:

1. An apparatus for the reclamation of aggregate from unset concrete comprising in combination:

(a) an inclined drum mounted for rotation about an inclined axis, said drum having an upper end, a lower end and a sidewall portion extending between said upper and lower ends, (b) said lower end comprising a barrier wall extending across the lower end of said drum, (c) means to rotate said drum about said inclined axis, (d) an upper opening adjacent the upper end of said inclined drum, (e) a reservoir space within said inclined drum, said reservoir space being formed by at least a portion of the barrier wall extending across the lower end of the drum and at least a portion of the underside of the sidewall of said drum, said reservoir space being adapted for the reception and accumulation of unset concrete, (f) means to charge unset concrete from said upper opening of the drum into said reservoir space, said means comprising a downwardly inclined elongated tube having an inlet opening adjacent said upper opening of the drum and an outlet opening adjacent said reservoir space, (g) aggregate conveyor means disposed between the interior of said inclined drum and the exterior of said elongated tube of (f), the lower end of the conveyor means partially extending into said reservoir space, (h) at least one outlet for aggregate adjacent the upper end of said inclined drum, (i) said means for rotating said drum also is for rotating said conveyor means so that aggregate is conveyed upwardly from said reservoir space between the interior of said drum and the exterior of said elongated cylindrical tube to said at least one outlet for aggregate adjacent the top of said inclined drum, (j) a lower liquid slurry opening extending thru said drum, said lower liquid slurry opening being at a lower level than said upper opening (d), said lower opening being approximately level with the top level of said reservoir space and being adapted to discharge a liquid slurry from the inclined drum, (k) said slurry opening comprises a tube projecting coaxially into said drum and a canister fixed coaxially on said tube; said canister being open at its lower end and sheltering an aperture in said tube, whereby aggregate is shifted from said reservoir space to at least one of said outlets for aggregate.

2. An apparatus according to claim 1 wherein said aggregate conveyor means comprises Archemedian screw-type conveyor flutes fixed to the inner surface of said inclined drum.

3. An apparatus according to claim 2 wherein said Archemedian flutes are pierced by holes through which said slurry may be separated from said aggregate during its conveyance by said flutes by counter-flowing water.

4. An apparatus according to claim 1 having fins fitted to the internal surface of said drum towards the lower end of said drum whereby wet concrete is lifted and allowed to fall back into said reservoir space.

5. An apparatus according to claim 1 wherein said drum is provided with a circumferential zone in the form of a screen or sieve located near the upper end of said drum whereby sand may be separated from aggregate prior to discharge.

6. An apparatus for the reclamation of aggregate from unset concrete comprising in combination:

(a) an inclined drum mounted for rotation about an inclined axis, said drum having an upper end, a lower end and a sidewall portion extending between said upper and lower ends, (b) said lower end comprising a barrier wall extending across the lower end of said drum, (c) means to rotate said drum about said inclined axis, (d) an upper opening adjacent the upper end of said inclined drum, (e) a reservoir space within said inclined drum, said reservoir space being formed by at least a portion of the barrier wall extending across the lower end of the drum and at least a portion of the underside of the sidewall of said drum, said reservoir space being adapted for the reception and accumulation of unset concrete, (f) means to charge unset concrete from said upper opening of the drum into said reservoir space, said means comprising a downwardly inclined elongated tube having an inlet opening adjacent said upper opening of the drum and an outlet opening adjacent said reservoir space, (g) aggregate conveyor means disposed between the interior of said inclined drum and the exterior of said elongated tube of (f), the lower end of the conveyor means partially extending into said reservoir space, (h) at least one outlet for aggregate adjacent the upper end of said inclined drum, (i) said means for rotating said drum also is for rotating said conveyor means so that aggregate is conveyed upwardly from said reservoir space between the interior of said drum and the exterior of said elongated cylindrical tube to said at least one outlet for aggregate adjacent the top of said inclined drum, (j) a lower liquid slurry opening extending thru said drum, said lower liquid slurry opening being at a lower level than said upper opening (d), said lower opening being approximately level with the top level of said reservoir space and being adapted to discharge a liquid slurry from the inclined drum, (k) said slurry opening comprises a canister fixed co-axially with said drum and open at its lower end, a tube mounted radially inwardly from said canister and mounted longitudinally with respect to said drum and passing through the wall of said drum, whereby outflow of aggregate with slurry is eliminated or substantially reduced, (l) whereby aggregate is shifted from said reservoir space to at least one of said outlets for aggregate.

7. An apparatus according to claim 6 wherein said canister is fitted with an archemedian screw counter-rotating to said main drum conveyor screw to carry aggregate towards the open lower end of the canister.

* * * * *